US007281711B2

(12) United States Patent
Dannemann et al.

(10) Patent No.: US 7,281,711 B2
(45) Date of Patent: Oct. 16, 2007

(54) BLOWING-AIR HOLDING-DOWN ARRANGEMENT AND SHEET-ALIGNING DEVICE PROVIDED THEREWITH

(75) Inventors: Georg Dannemann, Backnang (DE); Christoph Beck, Spiegelberg (DE); Bodo Tegtmeier, Alfdorf-Pfahlbronn (DE); Eberhard Krieger, Weinstadt-Struempfelbach (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 560 days.

(21) Appl. No.: 10/835,384

(22) Filed: Apr. 30, 2004

(65) Prior Publication Data

US 2004/0245696 A1 Dec. 9, 2004

(30) Foreign Application Priority Data

May 8, 2003 (EP) ..... 03010430

(51) Int. Cl.
*B65H 9/16* (2006.01)

(52) U.S. Cl. ..... 271/248; 271/250; 271/253; 271/254; 271/264

(58) Field of Classification Search ..... 271/264, 271/248, 250, 253, 254
See application file for complete search history.

(56) References Cited

U.S. PATENT DOCUMENTS 3,401,930 A 9/1968 Bishop
3,918,706 A 11/1975 Craft
5,183,251 A * 2/1993 Sardella ..... 271/276
2001/0015523 A1* 8/2001 Helmstadter et al. ..... 271/276

FOREIGN PATENT DOCUMENTS

| | | |
|---|---|---|
| DE | 468 077 C | 11/1928 |
| DE | 479 146 C | 7/1929 |
| DE | 519 519 C | 2/1931 |
| DE | 679 390 C | 8/1939 |
| DE | 2 139 423 A | 3/1972 |
| EP | 1 209 539 A2 | 5/2002 |

* cited by examiner

*Primary Examiner*—David H Bollinger
(74) *Attorney, Agent, or Firm*—Rothwell, Figg, Ernst & Manbeck, P.C.

(57) ABSTRACT

The holding-down arrangement for holding down a sheet (24) in a sheet-bearing region of a sheet-processing machine, in particular of a folding machine, includes a plurality of blowing devices (19, 21) which, during use, are directed toward a sheet (24) and direct an air jet (20, 22) onto the sheet (24). The holding-down arrangement may be fitted in a sheet-aligning device which is arranged downstream of a sheet infeed and includes a sheet-bearing device (12), on which an incoming sheet (24) comes to rest.

6 Claims, 2 Drawing Sheets

BLOWING-AIR HOLDING-DOWN ARRANGEMENT AND SHEET-ALIGNING DEVICE PROVIDED THEREWITH

FIELD OF THE INVENTION

The invention relates to a holding-down arrangement for holding down a sheet in a sheet-bearing region of a sheet-processing machine, and to a sheet-aligning device which comprises such a holding-down arrangement.

DESCRIPTION OF THE BACKGROUND ART

DE A 1 611 362 discloses a sheet-aligning device which comprises a sheet-bearing device which is formed by corrugated resilient strips. On one side, the sheet-bearing device is bounded by an aligning rail which can be adjusted along an axis, transversely to the sheet-infeed direction, for adjustment to the sheet width. Provided on the other side of the sheet-bearing device are a bottom guide and a top guide, between which the sheet is introduced. The top guide and the bottom guide can likewise be adjusted along the axis, transversely to the sheet-infeed direction, for adaptation to the sheet width. Above the center of the sheet-bearing device, a holding-down bar is arranged just above the sheet-bearing device, this bar preventing an incoming sheet from rising up. In the case of wide sheet-bearing devices, it is necessary to have a plurality of holding-down bars spaced apart one beside the other in order to prevent the sheet from rising up over the entire width of the sheet-bearing device. The arrangement of a plurality of holding-down bars is presented, for example, in German Utility Model 84 06 391. The plurality of holding-down bars are fixed above the sheet-bearing device. If the sheet-bearing device is to be adjusted to a smaller format, the aligning rail can be displaced in the direction of the center of the sheet-bearing device, counter to the force of the resilient elements. Since the holding-down bars are located level with the aligning rail, it is necessary to remove holding-down bars which are fitted within the adjusting path. At the same time, it is also necessary to adjust the bottom rail and the top rail, for which reason it may be necessary to remove further holding-down bars. Installation or removal of holding-down bars, however, involves very high outlay.

SUMMARY OF THE INVENTION

The object of the invention is to provide, using means of straightforward design, a holding-down arrangement and a sheet-aligning device, provided with the holding-down arrangement, which make it possible for the sheet-aligning device to be adjusted to different sheet widths without it been necessary for holding-down elements to be installed or removed.

This object is achieved by a holding-down arrangement and by a sheet-aligning device as disclosed herein.

Advantageous developments of the holding-down arrangement according to the invention are also disclosed herein. Preferred embodiments of the sheet-aligning device are also disclosed herein.

Since the holding-down arrangement according to the invention holds down the sheets by the air jet of the blowing devices, it is possible for the holding-down arrangement to be arranged further above the sheet-bearing device than is the case with the known holding-down bars, which can be arranged just above the sheet-bearing device. The holding-down arrangement may be arranged at a higher level, in the adjusting region of an aligning rail, than the aligning rail, with the result that there is no chance of collision with one or more holding-down arrangements during the adjustment of the aligning rail. There is thus no longer any need for the holding-down arrangement to be installed or removed during adaptation of the sheet-bearing device to a sheet width.

The blowing devices are preferably arranged such that the air jet, during use, is inclined in the running direction of a sheet. It is thus possible to assist the movement of the sheet in the sheet-running direction.

Outside the adjusting region of the aligning rail, the previously known holding-down profiles may be arranged just above the sheet-bearing device since there is no risk of collision with the aligning rail here.

In the case of a preferred embodiment, the sheet-bearing device has, on the sides opposite the aligning rail, a sheet-bearing plate which has a plurality of blowing devices which are directed toward the underside of the sheet and are designed such that they direct onto the underside of the sheet an air jet which is inclined in the sheet-running direction. The air jet forms a kind of air cushion, which prevents static attraction of the sheet on the paper rest. Since the air jets are inclined in the sheet-running direction, this additionally assists the movement of the sheet in the sheet-running direction.

The blowing devices of the sheet-bearing plate and of the holding-down arrangements are connected to a pressure-generating device, it being possible for the quantity and the pressure of the air to be regulated for optimum adjustment.

BRIEF DESCRIPTION OF THE DRAWINGS

Exemplary embodiments of the invention are explained in more detail hereinbelow with reference to drawings, in which.

DETAILED DESCRIPTION OF THE INVENTION

Figure 1:
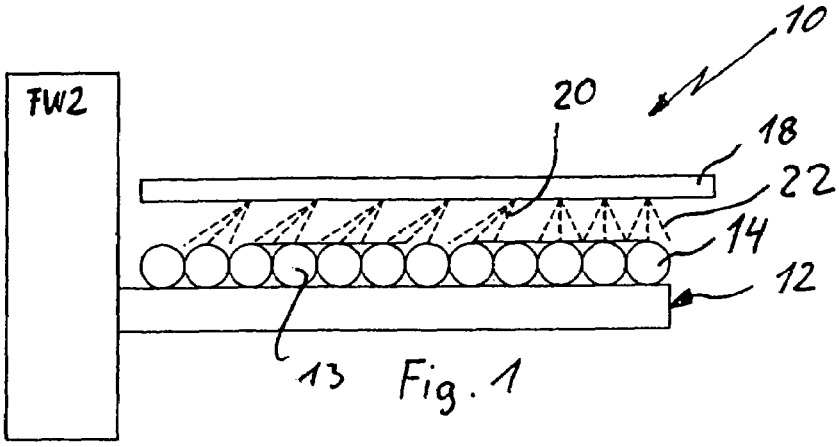
FIG. 1 shows, schematically, a side view of a sheet-aligning device for conveying and uniformly aligning sheets.
Figure 2:
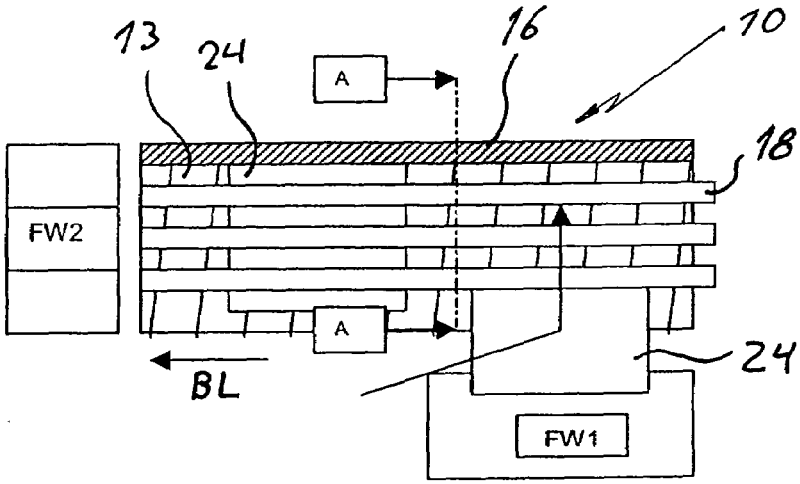
FIG. 2 shows a schematic plan view of the sheet-aligning device from FIG. 1.
Figure 3:
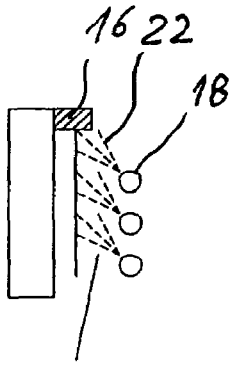
FIG. 3 shows the section A-A from FIG. 2.

The sheet-aligning device 10 which is shown in FIG. 1 serves for conveying and aligning a sheet 24 from a first folding unit FW1 to a second folding unit FW2. The sheet-aligning device 10 comprises an angled-roller table 12 with a plurality of driven rollers 13 arranged one after the other in the longitudinal direction. An aligning rail 16 is arranged on that longitudinal side of the angled-roller table 12 which is at the top in FIG. 2. The rollers 13 extend transversely to the longitudinal direction of the angled-roller table 12. The axis of the rollers 13 is inclined slightly counter to the sheet-running direction BL, in the direction of the aligning rail 16. The first folding unit FW1 is arranged on that side of the angled-roller table 12 which is located opposite the aligning rail 16, at that end of the angled-roller table 12 which is on the right in FIG. 2. The second folding unit FW2 is located on that end side of the angled-roller table 12 which is located downstream in the sheet-running direction BL.

A sheet-bearing plane is formed by the rollers 13 arranged in one plane. Above the sheet-bearing plane, three tubular holding-down bars 18 are arranged one beside the other in one plane, and extend in the longitudinal direction of the angled-roller table 12, i.e. in the sheet-running direction BL. Provided in the underside of the holding-down bars 18, in the region in which the first folding unit FW1 is arranged, are a plurality of through-passage openings 19 (FIG. 4), which are inclined downward in the direction of the aligning rail 16 in order for an air jet 22 which passes out through the through-passage openings 19 to be directed in the direction of the aligning rail 16. A sheet 24 passing out of the first folding unit FW1 is conveyed onto the bearing plane of the angled-roller table 12, perpendicularly to the longitudinal direction of the angled-roller table 12, until it comes into abutment against the aligning rail 16. It is retained on the bearing plane here by the air jet 22 passing out of the holding-down means 18, the movement of the sheet 24 in the direction of the aligning rail 16 being assisted by the air jet 22. The sheet 24 is then conveyed by the rollers 13 in the direction of the second folding unit FW2, abutment of the sheet edge against the aligning rail 16 being ensured on account of the rollers 13 being arranged in an angled manner in relation to the aligning rail 16. In the region in which the sheet 24 is conveyed in the longitudinal direction of the angled-roller table 12, a plurality of through-passage openings 21 (FIG. 4) are spaced apart from one another in the longitudinal direction in the holding-down means 18. These through-passage openings 21 are designed such that an air jet 20 which passes out through the through-passage openings 21 is directed in the sheet-running direction BL, as a result of which the movement of the sheet 24 in the direction of the second folding unit FW2 is assisted. At the same time, the sheet 24 is held down by the air jets 20.

Figure 4:
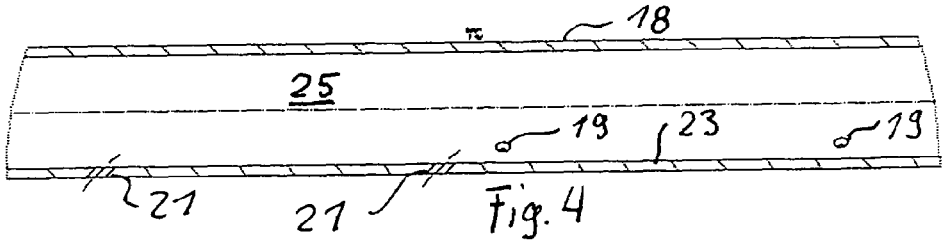
FIG. 4 shows a longitudinal section through a holding-down bar of the sheet-aligning device from FIG. 1.

As has been mentioned above, the holding-down bars 18 are of tubular design. They have a closed interior 25 (FIG. 4) which is enclosed by a tube wall 23 (FIG. 4). The interior 25 is connected to a regulatable pressure-generating device (not shown) by means of which it is possible to introduce air at a regulatable pressure into the holding-down bars 18, this air passing out through the through-passage openings 19, 21 in the tube wall 23 in order to form the air jets 20, 22.

Figure 5:
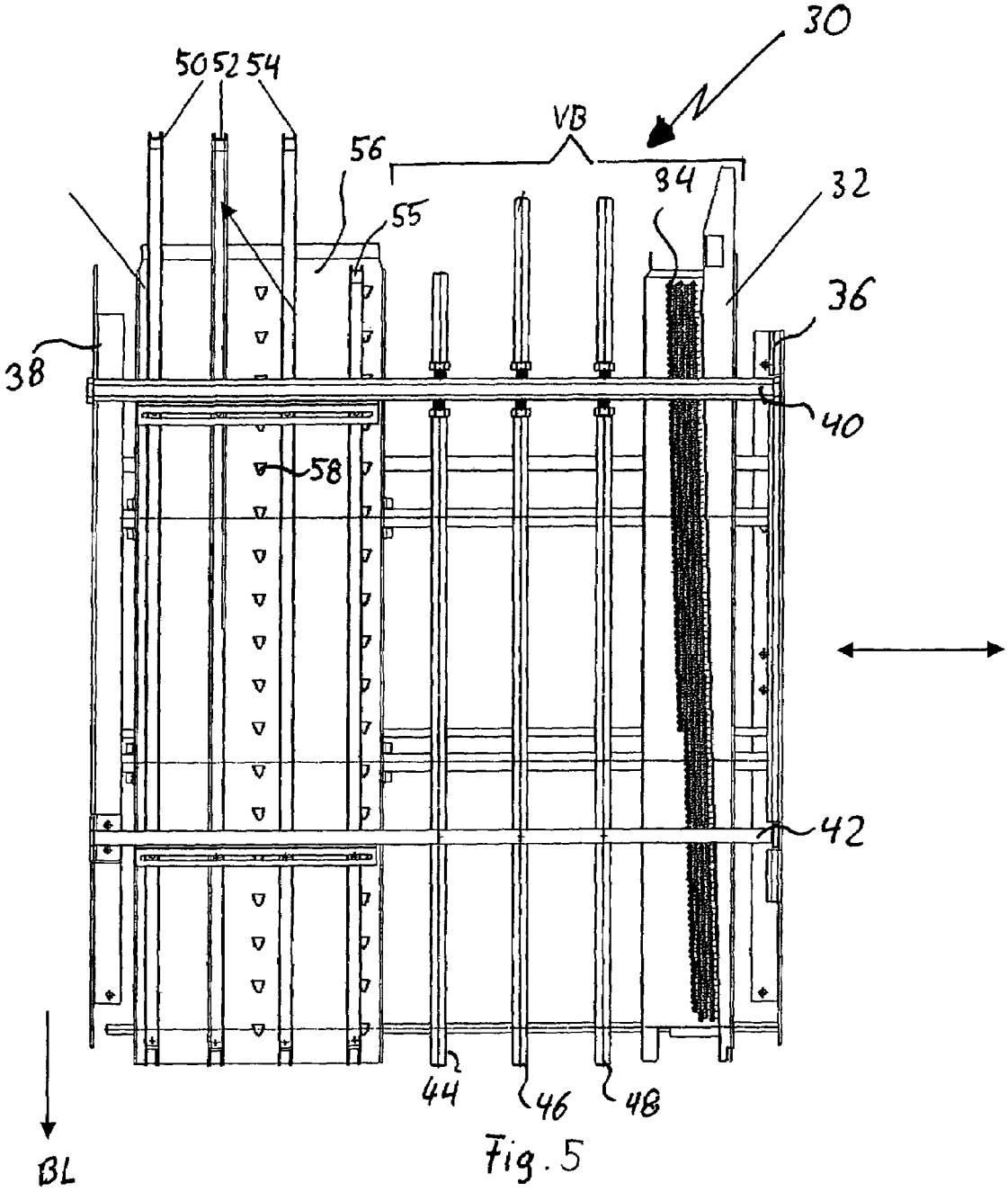
FIG. 5 shows a schematic plan view of a second embodiment of a sheet-aligning device.

The second embodiment of the sheet-aligning device 30, which is shown in FIG. 5, has two spaced-apart side-frame elements 36, 38 extending in the sheet-running direction BL. An aligning rail 32, likewise extending in the sheet-running direction BL, forms, together with an angled conveying belt 34, a unit which can be adjusted transversely to the sheet-running direction for adaptation to the sheet width. Above the aligning rail 32, two transverse struts 40, 42, which extend transversely to the sheet-running direction, are fastened on the side frames 36, 38. The aligning rail 32 can be adjusted in an adjusting region VB together with the angled belt 34. Within the adjusting region VB, three tubular holding-down bars 44, 46, 48 are fastened on the transverse struts 40, 42 such that they are located at a higher level than the aligning rail 32. The holding-down bars 44, 46, 48 are designed like the holding-down bars 18 of the first embodiment, the air jet form the through-passage openings being directed in the sheet-running direction BL. The adjusting region VB is followed by a bearing plate 56 extending in the sheet-running direction BL. The surface of the bearing plate 56 is located in the bearing plane of the sheet-aligning device 30. The bearing plate 56 has a closed interior which is connected to a regulatable pressure-generating device (not shown). Provided in the top side of the bearing plate 56 are three rows of through-passage openings 58, these extending in the sheet-running direction BL and being designed such that an air jet from the through-passage openings 58 is inclined in the sheet-running direction BL. The left-hand row cannot be seen in FIG. 5 since it is arranged beneath a holding-down means 50. The quantity and the pressure of the air which passes out can be regulated by regulation of the pressure-generating device. Above the bearing plate 56, four holding-down means 50, 52, 54, 55 extending in the sheet-running direction are fixed on the transverse struts 40, 42 such that they are arranged just above the bearing plane, as is the case with known holding-down means.

Since the holding-down bars 44, 46, 48 are arranged at a higher level than the aligning rail 32, it is possible for the aligning rail 32, together with the angled belt 34, to be adjusted within the adjusting region without colliding with the holding-down bars 44, 46, 48. The air which passes out of the through-passage openings 58 forms a kind of air cushion for an incoming sheet, this air cushion preventing static attraction between the sheet and the bearing plate 56. This makes it possible for the bearing plate 56 to be of relatively wide configuration, with the result that there is no need for elements to be adjusted to the sheet width on that side of the sheet-aligning device 30 which is opposite the aligning guide 32.

What is claimed is:

1. A sheet-aligning device for a sheet-processing machine which is arranged downstream of a sheet infeed, comprising a sheet-bearing device, on which an incoming sheet comes to rest, and at least one holding-down arrangement arranged above said sheet-bearing device and comprising a plurality of blowing devices which are directed toward said sheet-bearing device and direct an air jet onto said sheet, wherein an aligning rail extends in a sheet-running direction, the aligning rail being adjustable in an adjusting region transversely to the sheet-running direction and above said sheet-bearing device for aligning a sheet, and wherein said holding-down arrangement is arranged at a higher level in said adjusting region than said aligning rail.

2. The sheet-aligning device as claimed in claim 1, wherein said blowing devices are arranged such that said air jet is inclined in said sheet-running direction.

3. The sheet-aligning device as claimed in claim 1, wherein holding-down profiles, which extend in said sheet-running direction outside said adjusting region, are fixed just above said sheet-bearing plane.

4. The sheet-aligning device as claimed claim 1, wherein said sheet-bearing device comprises a sheet-bearing plate having a plurality of blowing devices which are directed toward an underside of a sheet and designed such that they direct onto said underside of said sheet an air jet which is inclined in said sheet-running direction.

5. The sheet-aligning device as claimed in claim 4, wherein said blowing devices are formed by through-passage openings which are formed in said sheet-bearing plate and are in fluid connection with a pneumatic pressure-generating device.

6. The sheet-aligning device as claimed in claim 5, wherein said through-passage openings are arranged in a plurality of spaced-apart rows which extend in said sheet-running direction.

* * * * *